United States Patent [19]

Blackwell

[11] 4,099,451

[45] Jul. 11, 1978

[54] OILWELL SWAB CUP

[75] Inventor: Henry Wayne Blackwell, Venus, Tex.

[73] Assignee: Dresser Industries, Inc., Dallas, Tex.

[21] Appl. No.: 756,304

[22] Filed: Dec. 27, 1976

[51] Int. Cl.[2] ..... F16J 1/04; F16J 15/32

[52] U.S. Cl. ..... 92/241; 166/202; 417/555 A

[58] Field of Search ..... 92/241, 254; 417/555 A; 166/202; 29/156.5

[56] References Cited

U.S. PATENT DOCUMENTS

| | | | |
|---|---|---|---|
| 2,305,282 | 12/1942 | Taylor, Jr. et al. | 92/241 |
| 2,317,433 | 4/1943 | Bell | 92/254 |
| 2,512,098 | 6/1950 | Gratzmuller | 92/254 X |
| 2,664,952 | 1/1954 | Losey | 92/241 |
| 2,862,776 | 12/1958 | Bowerman | 92/241 |
| 2,918,336 | 12/1959 | Works et al. | 92/254 X |
| 3,724,337 | 4/1973 | Richardson | 417/555 A |

*Primary Examiner*—Irwin C. Cohen

*Attorney, Agent, or Firm*—Roy L. Van Winkle; Richard M. Byron

[57] ABSTRACT

An oilwell swab cup is formed by clamping a plurality of vertical wire members in a circular U-shaped cup and molding an elastomeric material around the wires and cup.

1 Claim, 3 Drawing Figures

OILWELL SWAB CUP

BACKGROUND OF THE INVENTION

The present invention generally relates to structures for use in swabbing fluid from an oil-well bore and more particularly involves a reinforcing structure for a swab cup and the method of manufacturing it.

Swabbing generally is the removal of liquid from a well by means of a sealing element mounted on a tool and lowered into a well by means of a wireline. The tool is lowered through a suitable amount of tubing and then lifted within the well effecting a seal with the pipe and lifting fluid above the tool to the surface. Packer cups are generally used to seal well pressure in one direction and are mounted on a well tool and positioned in a sealing engagement with well pipe. Packer cup application normally is a static or limited movement application.

There are a multitude of prior well swab bodies using a plurality of shaped wires held in base structures of various types as the reinforcing structure. See, for example, U.S. Pat. No. 2,887,347 issued to T. B. Losey. Also, see U.S. Pat. Nos. 3,724,337, 3,724,338 and 2,581,981 in which vertical reinforcing wires are clamped between two concentric base rings and an elastomeric material is bonded therearound.

There are also prior well swabs employing metallic cones or corrugated cylinders as the reinforcing structure. See, for example, U.S. Pat. No. 1,898,292 issued to C. S. Crickmer and U.S. Pat. No. 2,013,903 issued to F. A. Thaheld. There are also prior well swabs employing slotted metallic cylinders as wear protective structures. See, for example, U.S. Pat. No. 2,619,393 issued to R. E. Wilson and J. A. Wilson and U.S. Pat. No. 2,456,551 issued to R. A. Wilson.

The disadvantages of the aforementioned swabs which utilize upstanding tines or wires clamped between two concentric base rings are serious and include the particularly bothersome problem of "drift" during molding.

The normal procedure for manufacturing swab cups is to locate a complete set of reinforcing wires between two concentric base rings and then swage one or both of the rings into tight clamping arrangement with the wires. For example, the aforementioned U.S. Pat. Nos. 3,724,337 and 3,724,338 generally located the vertical wires between a hardened metal outer ring and a softer metal inner ring and then "expand" the inner ring outward to clamp the wires in place.

After the reinforcing structure is formed, it is usually then placed inside a swab cup mold and viscous elastomeric material is pressure injected into the mold to encapsulate the metal structure and fill in and around all the open spaces in the wires and base rings. The elastomer is then cured, and the cup is trimmed and is ready for use.

The difficulty encountered with this process is that the pressure injection step, involving radical thermal changes and high flow rates, tends to separate the two base rings and float them apart some distance. This results in misalignment of the upward extending wires as well as a weakening of the entire swab structure. Oftentimes, the wires will protrude through the side of the elastomeric wall and resulting in rapid wear and breakage.

In addition to this disadvantage, the hardening of the base ring is an additional step that results in greater expense and time of manufacture. This hardening is done in the prior art methods (which swage outward) in order to maintain the reinforcing cage OD within acceptable dimensional tolerances.

Disadvantages with unitary cup reinforcing structures made from tubular material are due to the time consuming machining operations and resultant high cost.

These disadvantages are overcome by the present invention which utilizes a single U-shaped annular base cup to receive the upward tines therein and which can be swaged inward to clamp the tines tightly. Because the base is a single element, it eliminates any "drift" encountered during injection molding of the elastomer. The present invention also eliminates the need for providing a hardened metal base ring.

DESCRIPTION OF THE PREFERRED EMBODIMENTS

Figure 1:
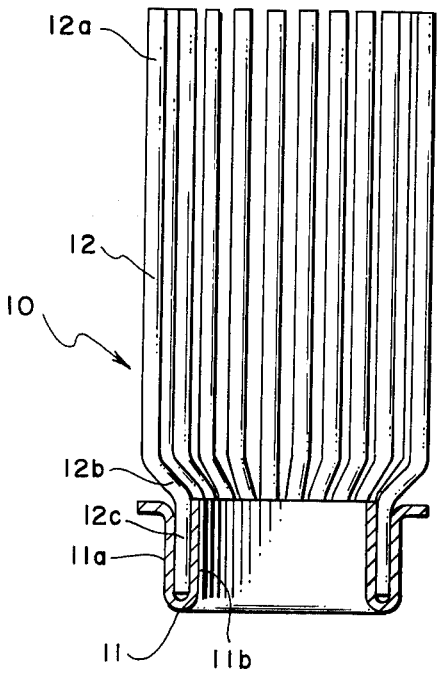
FIG. 1 is a cross-sectional side view of the reinforcement structure.
Figure 2:
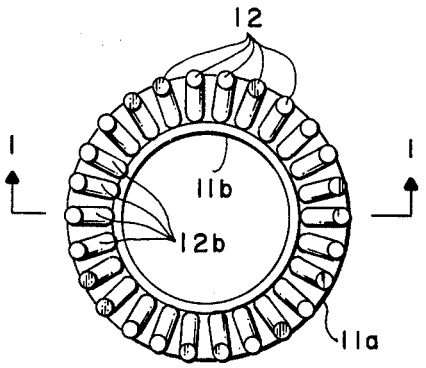
FIG. 2 is an end view of the structure of FIG. 1.

Referring to FIGS. 1 and 2, the present invention discloses a metal reinforcing structure 10 for use in an elastomeric well swab element. Although the reinforcement structure is depicted as metal, it could be of any suitable strong material such as fiberglass or plastic.

Structure 10 consists of a plurality of upwardly extending wires 12 rigidly secured inside a U-shaped circular base cup 11. Wires 12 may have a circular cross-sectional shape or be of any other convenient configuration. They have an elongated upper portion **12*a*, an S-curved intermediate portion 12*b*, and a short lower end 12*c***. The combination of this plurality of wires forms a generally cylindrical cage assembly having a narrowed lowered end.

The base cup 11 is preferably formed from a single annular piece of metal pressed or forged into the U-shaped configuration illustrated. The wires 12 are placed in the slot formed in the base cup 11, and the outer wall **11*a* may be swaged downward to hold the wires tightly therein. Alternatively, the inner wall 11*b*** may be swaged outward to clamp the wires tightly.

After the wires have been clamped tightly in the base cup in a relatively equispaced relationship, the structure is then placed in a swab cup injection mold and positioned therein by means well-known in the art.

A viscous elastomeric material is then injected into the mold under sufficient heat and pressure to fill in all the spaces around the wires and base cup. After the elastomer sets up, it may be cured by well-known means and then finished to size.

Figure 3:
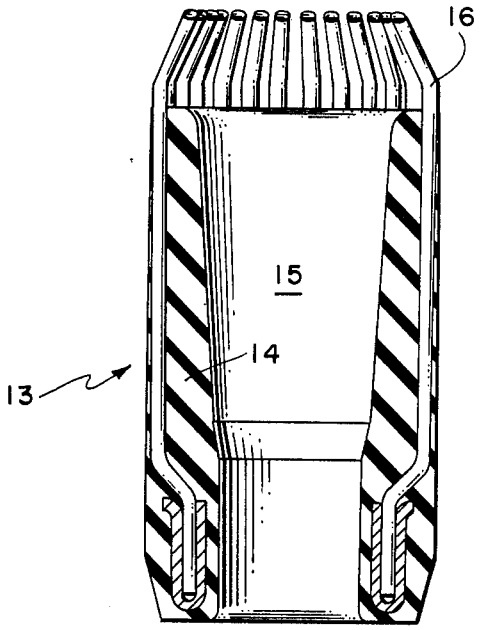
FIG. 3 is a cross-sectional view of a finished swab cup.

FIG. 3 illustrates the finished swab cup 13 having an elastomeric material 14 bonded therearound. A central bore passage 15 is provided through the swab cup to allow its placement on the swab mandrel.

An inward crimp 16 of the wires 12 at their upper ends may be provided to prevent the swab cup from hanging in the collars when moving up the conduit string with a load of fluid.

Thus, by providing a base comprising a single element, this invention has solved the problem of drift occurring in multi-element base sections. Also, by providing a single base element, this invention allows an inward swaging step to clamp the wires in place, thus eliminating the required hardening step of the prior art structures. The outer wall of the base cup is of the same generally soft metal as the inner wall and can be swaged down to the required size. A swaging mandrel is normally used inside the base cup inner **11*b*** to prevent deformation of the inner wall.

Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For instance, whereas the use of individual wires are illustrated, it is clear that a single cylindrical tube could be used by cutting vertical slots through the wall to form upward extending tines. Also, other means than swaging can be used to clamp the wires in place in the base cup such as resins or so-called super glues like cyanomethacrylate. Other materials than metal can be used to form the wires and/or the base cup. Thus, the invention is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. An improved swab cup assembly comprising:

a unitary base member of U-shaped cross section press formed from a single annular, malleable plate to include an annular bottom portion having inner and outer peripheral edges and first and second wall portions, said first wall portion extending from the inner peripheral edge of said bottom portion and said second wall portion extending from the outer peripheral edge of said bottom portion, said wall portions extending in spaced, generally concentric parallel relationship forming an annular slot therebetween;

a plurality of elongated wire members having straight lower end portions, S-shaped intermediate portions, and inwardly bent upper portions, said lower portions being disposed in said slot in circumferentially spaced relationship and in tight, frictional engagement with said wall portions whereby the lower end portions of said wire members are retained immobile with respect said base member and each other; and, elastomeric means encapsulating said base member and lower and intermediate portions of each of said wire members for forming said base member and wire members into an annular swab cup assembly.

* * * * *